US006416169B1

(12) United States Patent
Gooray et al.

(10) Patent No.: US 6,416,169 B1
(45) Date of Patent: Jul. 9, 2002

(54) MICROMACHINED FLUID EJECTOR SYSTEMS AND METHODS HAVING IMPROVED RESPONSE CHARACTERISTICS

(75) Inventors: Arthur M. Gooray; George J. Roller, both of Penfield, NY (US); Joseph M. Crowley, Morgan Hill, CA (US); Paul C. Galambos; Frank J. Peter, both of Albuquerque, NM (US); Kevin R. Zavadil, Bernilillo, NM (US); Richard C. Givler, Albuquerque, NM (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/718,420

(22) Filed: Nov. 24, 2000

(51) Int. Cl.[7] ..... B41J 2/04

(52) U.S. Cl. ..... 347/54

(58) Field of Search ..... 347/54, 68, 69, 347/70, 71, 72, 50, 40, 20, 44, 47, 27; 399/261; 361/700; 29/890.1; 310/328–330

(56) References Cited

U.S. PATENT DOCUMENTS 1,941,001 A * 12/1933 Hansell
3,373,437 A * 3/1968 Sweet et al.
3,596,275 A * 7/1971 Sweet
3,683,212 A * 8/1972 Zolten
3,747,120 A * 7/1973 Stemme
3,946,398 A * 3/1976 Kyser et al.
4,459,601 A * 7/1984 Howkins
4,490,728 A * 12/1984 Vaught et al.
4,520,375 A 5/1985 Kroll
4,584,590 A * 4/1986 Fischbeck et al.
5,501,893 A 3/1996 Laermer et al.
5,668,579 A 9/1997 Fujii et al.
5,754,205 A 5/1998 Miyata et al.
5,783,340 A 7/1998 Farino et al.
5,798,283 A 8/1998 Montague et al.
5,804,084 A 9/1998 Nasby et al.
5,821,951 A 10/1998 Fujii et al.
5,828,394 A 10/1998 Khuri-Yakub et al.
5,919,548 A 7/1999 Barron et al.
5,963,788 A 10/1999 Barron et al.
6,082,208 A 7/2000 Rodgers et al.
6,087,638 A * 7/2000 Silverbrook
6,127,198 A 10/2000 Coleman et al.
6,171,875 B1 * 1/2001 Silverbrook
6,180,427 B1 * 1/2001 Silverbrook
6,217,183 B1 * 4/2001 Silverbrook
6,220,694 B1 * 4/2001 Silverbrook
6,238,040 B1 * 5/2001 Silverbrook
6,239,821 B1 * 5/2001 Silverbrook
6,243,113 B1 * 6/2001 Silverbrook
6,244,691 B1 * 6/2001 Silverbrook (List continued on next page.)

*Primary Examiner*—Raquel Yvette Gordon
(74) *Attorney, Agent, or Firm*—Oliff & Berridge, PLC

(57) ABSTRACT

A piston structure is movably mounted within a fluid chamber. Movement of the piston structure towards a faceplate causes a portion of the fluid between the piston and the faceplate to be forced out of the nozzle hole in the faceplate, forming a drop or jet of the fluid. Viscous forces that are generated by the flow of fluid along a working surface of the piston structure toward and away from the nozzle hole generate a force that resists the movement of the piston structure. This resistance force tends to slow the piston motion, and prevents the piston from contacting the faceplate. In various embodiments, the fluid chamber is defined by a cylinder structure. The piston structure moves within the cylinder structure. The cylinder structure and the faceplate define the fluid chamber. The cylinder structure and the piston structure are designed to cooperate so that the movement of the piston structure within the cylinder structure ejects fluid according to various design criteria. In various embodiments, a free space is provided between the faceplate and the piston structure at its maximum displacement towards the faceplate.

10 Claims, 3 Drawing Sheets

U.S. PATENT DOCUMENTS 6,245,247 B1 * 6/2001 Silverbrook
6,247,790 B1 * 6/2001 Silverbrook
6,247,791 B1 * 6/2001 Silverbrook
6,247,792 B1 * 6/2001 Silverbrook
6,247,795 B1 * 6/2001 Silverbrook
6,247,796 B1 * 6/2001 Silverbrook
6,477,794 * 6/2001 Silverbrook

* cited by examiner

FIG. 1
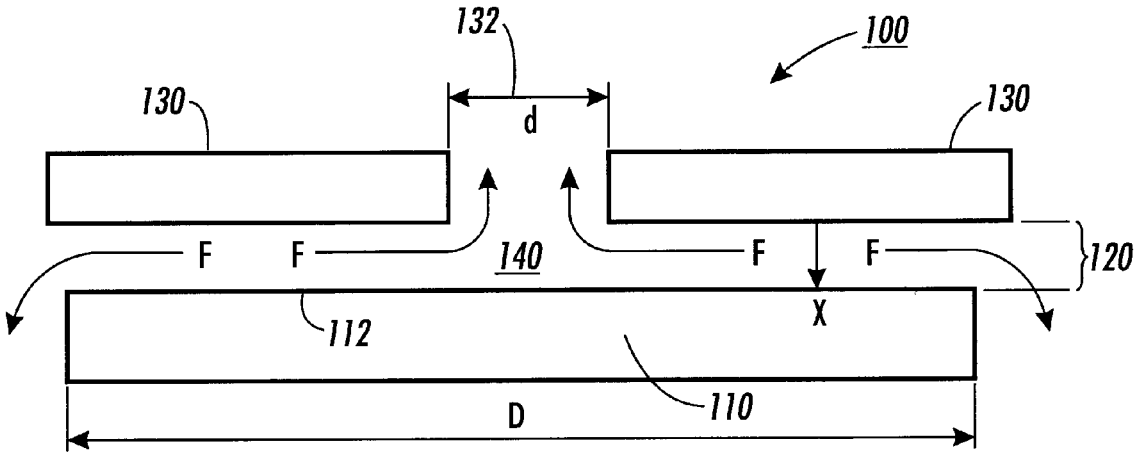
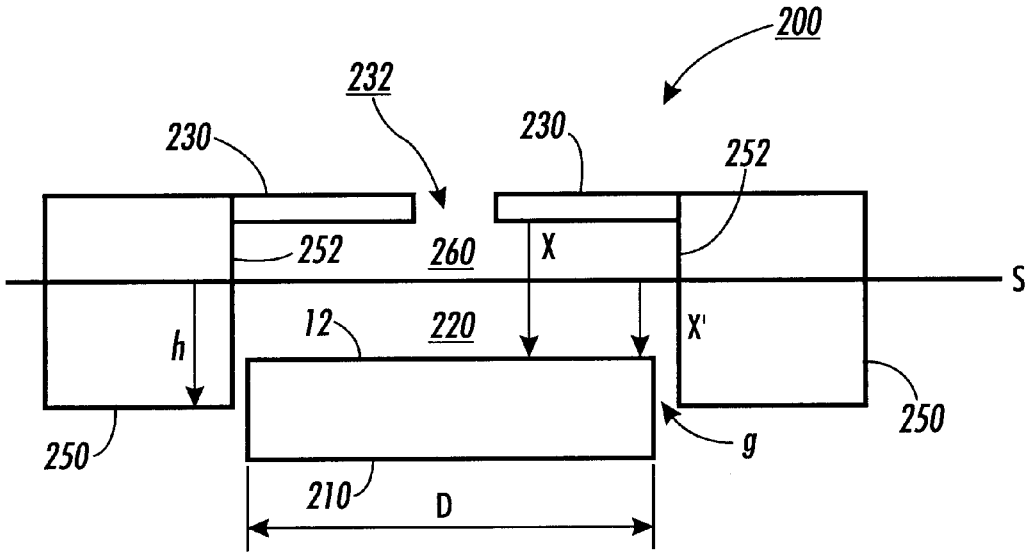
FIG. 2

FIG. 4
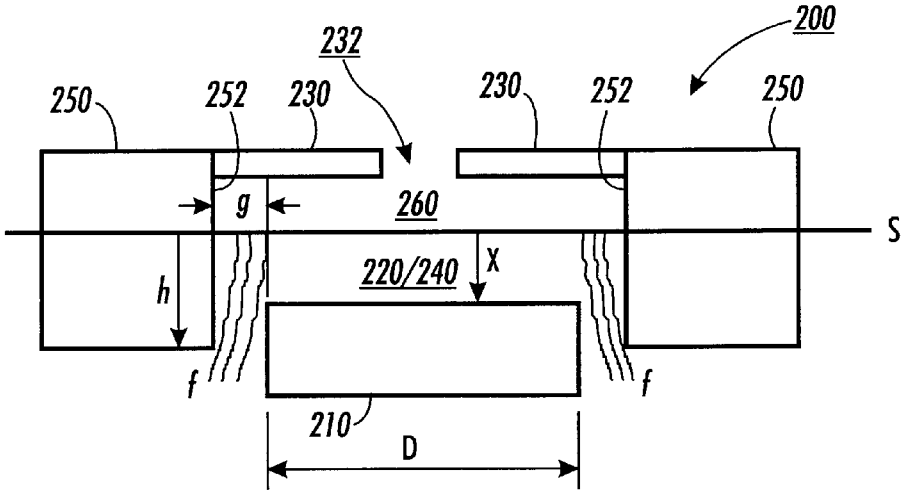
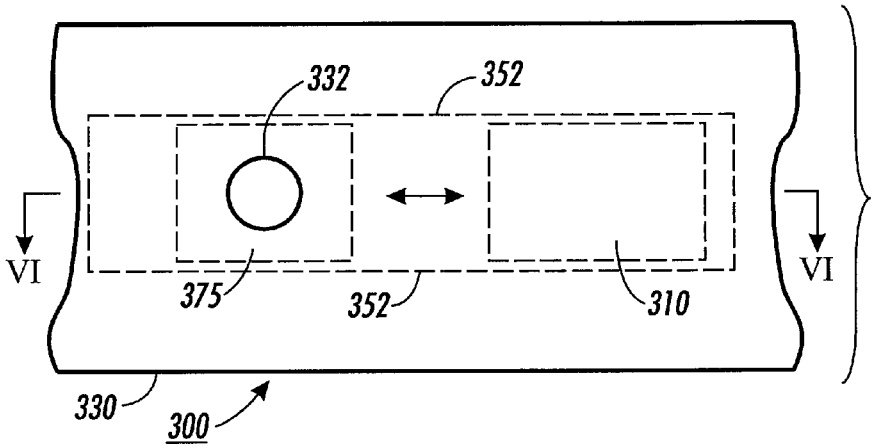
FIG. 5
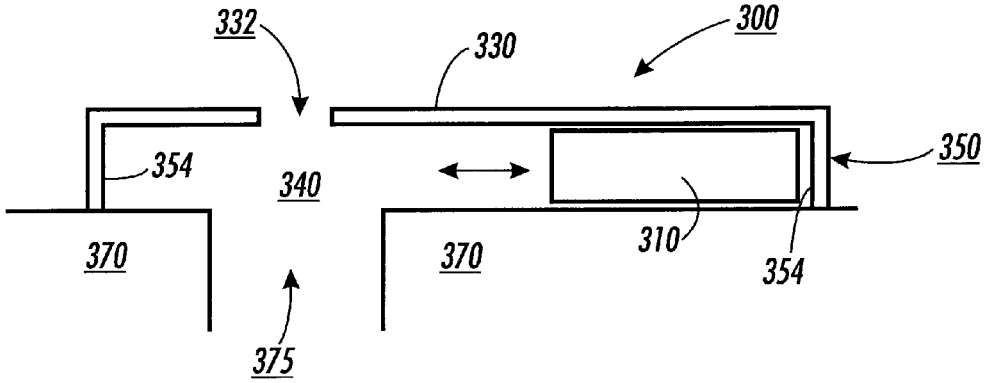
FIG. 6

MICROMACHINED FLUID EJECTOR SYSTEMS AND METHODS HAVING IMPROVED RESPONSE CHARACTERISTICS

BACKGROUND OF THE INVENTION

1. Field of the Invention

This present invention relates to micromachined or microelectromechanical system (MEMS) based fluid ejectors.

2. Description of the Related Art

Fluid ejectors have been developed for ink jet recording or printing. Ink jet printing systems offer numerous benefits, including extremely quiet operation when printing, high speed printing, a high degree of freedom in ink selection, and the ability to use low-cost plain paper. The so-called "drop-on-demand" drive method, where ink is output only when required for printing, is now the conventional approach. The drop-on-demand drive method makes it unnecessary to recover ink not needed for printing.

Fluid ejectors for ink jet printing include one or more nozzles which allow the formation and control of small ink droplets to permit high resolution, resulting in the ability to print sharper characters with improved tonal resolution. In particular, drop-on-demand ink jet print heads are generally used for high resolution printers.

Drop-on-demand technology generally uses some type of pulse generator to form and eject drops. For example, in one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface. Use of such a piezoelectric device as a driver is described in JP B-1990-51734.

Another type of print head uses bubbles formed by heat pulses to force fluid out of the nozzle. The drops are separated from the ink supply when the bubbles collapse. Use of pressure generated by heating the ink to generate bubbles is described in JP B-1986-59911.

Yet another type of drop-on-demand print head incorporates an electrostatic actuator. This type of print head utilizes electrostatic force to eject the ink. Examples of such electrostatic print heads are disclosed in U.S. Pat. No. 4,520,375 to Kroll and Japanese Laid-Open Patent Publication No. 289351/90. The ink jet head disclosed in the 375 patent uses an electrostatic actuator comprising a diaphragm that constitutes a part of an ink ejection chamber and a base plate disposed outside of the ink ejection chamber opposite to the diaphragm. The ink jet head ejects ink droplets through a nozzle communicating with the ink ejection chamber, by applying a time varying voltage between the diaphragm and the base plate. The diaphragm and the base plate thus act as a capacitor, which causes the diaphragm to be set into mechanical motion and the fluid to exit responsive to the diaphragm's motion. On the other hand, the ink jet head discussed in the Japan 351 distorts its diaphragm by applying a voltage to an electrostatic actuator fixed on the diaphragm. This result in suction of additional ink into an ink ejection chamber. Once the voltage is removed, the diaphragm is restored to its non-distorted condition, ejecting ink from the overfilled ink ejection chamber.

Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

This invention provides fluid ejection systems and methods having improved performance characteristics.

This invention separately provides fluid ejection systems and methods having improved response to actuation signals and improved control.

This invention provides fluid ejection systems and methods having improved efficiency.

This invention provides fluid ejection systems and methods requiring lower voltage to eject the fluid.

This invention provides fluid ejection systems and methods having increased drop generation rate.

This invention provides fluid ejection systems and methods having increased drop ejection velocities.

This invention provides fluid ejection systems and methods having reduced viscous fluid forces that oppose movement the actuator used to eject the fluid.

This invention provides fluid ejection systems and methods where the viscous fluid forces opposing movement the actuator used to eject the fluid that vary substantially linearly with displacement of the actuator.

This invention provides fluid ejection systems and methods where the viscous fluid forces opposing movement the actuator used to eject the fluid that prevent the actuator from contacting other structures of the ejector.

This invention provides fluid ejection systems and methods having fluid ejectors with improved structural features.

In various embodiments, the fluid ejectors according to this invention include an unsealed piston structure usable to eject fluid drops. In other various embodiments, the fluid ejectors according to this invention also include a cylinder structure. In still other various embodiments, the fluid ejectors according to this invention include a free space between the actuator and the faceplate that includes the nozzle hole.

According to various exemplary embodiments of the systems and methods of this invention, a micromachined fluid ejector includes a piston structure arranged to eject fluid drops. The piston structure is resiliently movably supported within a fluid chamber, such that movement of the piston ejects fluid. In various embodiments, the fluid chamber is defined by a cylinder structure so that the piston structure moves within the cylinder structure. In various other embodiments of this invention, a free space is provided between the piston structure and a faceplate including a nozzle hole.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention are described in detail below, with reference to the attached drawing figures, in which:

FIG. 1 is a cross-sectional view of a first exemplary embodiment of a fluid ejector according to this invention;

FIG. 2 is a cross-sectional view of a second exemplary embodiment of a fluid ejector according to this invention;

FIG. 4 is a cross-sectional view of the embodiment of FIG. 2 during movement of the piston towards the faceplate;

FIG. 5 is a top view of an alternative configuration of the exemplary embodiment shown in FIG. 2; and FIG. 6 is a cross-sectional view of the exemplary embodiment shown in FIG. 5 taken along line VI—VI.

DETAILED DESCRIPTION OF PREFERRED EMBODIMENTS

Figure 3:
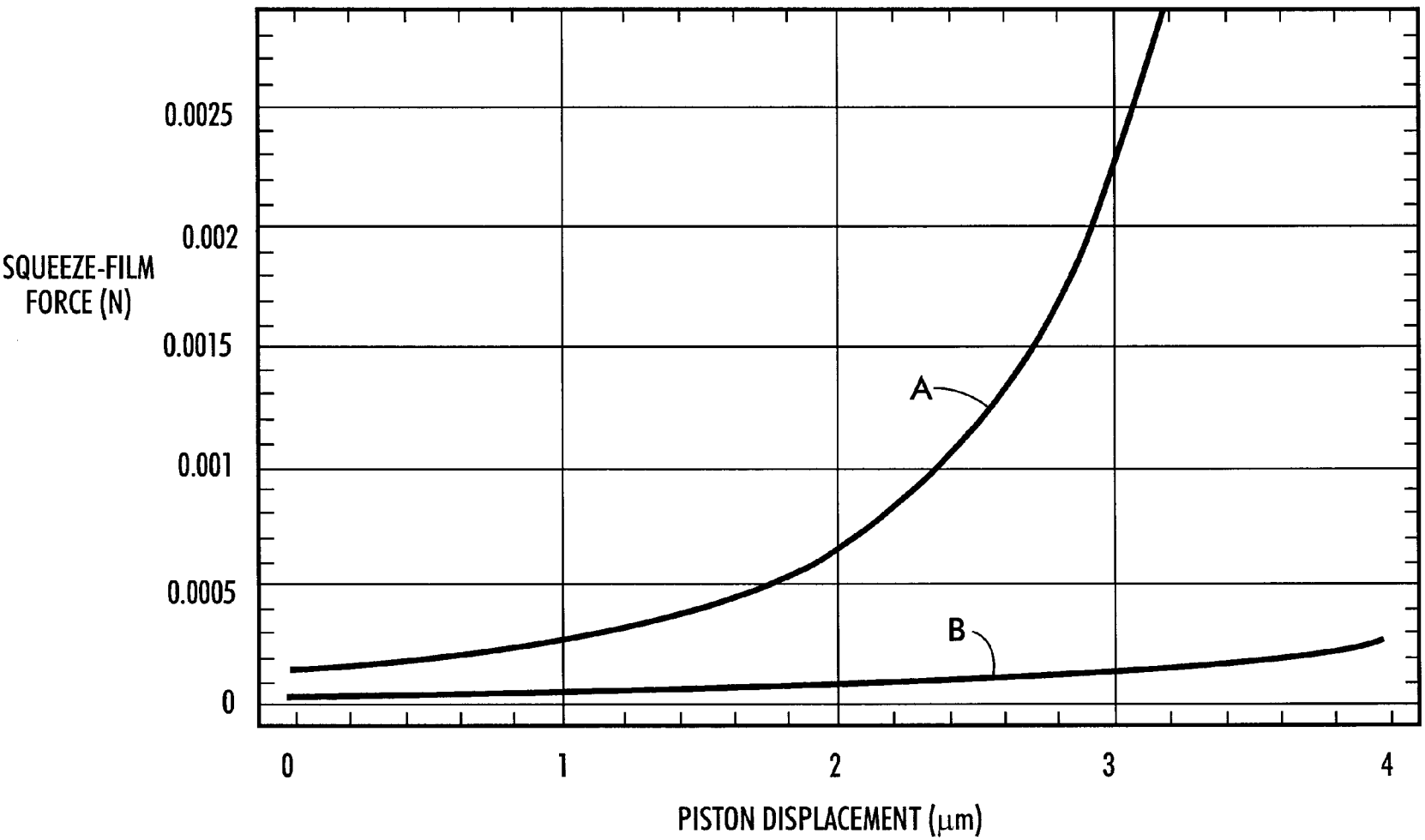
FIG. 3 is a plot of the squeeze-film force $F_{sq}$ as the piston structure is moved towards the faceplate for the exemplary embodiments shown in FIGS. 1 and 2.

The fluid ejectors according to this invention includes electrostatically or magnetically driven piston structures whose movement ejects a relatively small amount of fluid, commonly referred to as a drop or droplet. The fluid ejectors according to this invention may be fabricated using the SUMMiT processes or other suitable micromachining processes. The SUMMiT processes are covered by various U.S. patents belonging to Sandia National Labs, including U.S. Pat. Nos. 5,783,340; 5,798,283; 5,804,084; 5,919,548; 5,963,788; and 6,053,208, each of which is incorporated herein by reference in its entirety. The SUMMiT processes are primarily covered by the '084 and '208 patents. In particular, the methods discussed in copending U.S. patent application Ser. No. 09/723,243, filed herewith and incorporated herein by reference in its entirety, may be used.

Various design configurations of the micromachined fluid ejectors of the present invention are discussed in copending U.S. patent application Ser. No. 09/718,495, 09/718,476 and 09/722,331, each of which is filed herewith and incorporated herein by reference in its entirety. As with the systems and methods of this invention, these design configurations generally comprise a piston structure that is movably mounted within a fluid chamber. Movement of the piston structure towards a faceplate causes a fluid drop to be ejected through a nozzle hole.

Such movement can be effectuated through any suitable drive system. However, electrostatic and magnetic forces are particularly applicable. For example, electrostatic or magnetic attraction of the piston structure to the faceplate may be used to drive the piston structure. Alternatively, electrostatic or magnetic attraction of the piston structure to a baseplate on a side of the piston structure opposite the faceplate may be used to displace the piston structure away from the faceplate. In such a case, the piston structure is resiliently mounted so that a restoring force is generated to move the piston structure to its undisplaced position to eject a fluid drop. Another exemplary drive system suitable for this invention is an electrostatic comb drive.

As described above, movement of the piston structure causes a portion of the fluid between the piston and the faceplate to be forced out of the nozzle hole in the faceplate, forming a drop or jet of fluid. As the piston structure approaches the faceplate, viscous forces that are generated by the flow of the fluid along a working surface of the piston structure toward and away from the nozzle hole cause a force that resists the movement of the piston structure. Such resistance force tends to slow the piston motion, and prevents the piston from contacting the faceplate.

In various embodiments of this invention, the fluid chamber is defined by a "cylinder" structure so that the piston structure moves within the "cylinder" structure. This should not be read to imply that the "cylinder" structure is necessarily cylindrically-shaped. Rather, any appropriate shape can be used for the cylinder structure. The cylinder structure and the faceplate define the fluid chamber. The cylinder structure and the piston structure are designed to cooperate so that movement of the piston structure within the cylinder structure ejects fluid according to various design criteria.

In various exemplary embodiments of this invention, a free space is provided between the faceplate and the piston structure at its maximum displacement towards the faceplate. In other words, the cylinder structure extends from the faceplate so that a stroke of the piston structure within the cylinder structure will not allow the piston structure to enter the free space. The free space is designed to ameliorate the squeeze-film force.

FIG. 1 shows a first exemplary embodiment of an electrostatic microelectromechanical system (MEMS) based fluid ejector 100 according to this invention. The ejector 100 comprises a movable piston structure 110 and a stationary faceplate 130. A fluid chamber 120 is defined between the piston structure 110 and the faceplate 130. A fluid 140 to be ejected is supplied in the fluid chamber 120 from a fluid reservoir (not shown). The faceplate 130 includes a nozzle hole 132 through which a fluid jet or drop is ejected.

In this exemplary embodiment, the piston structure 110 moves towards the faceplate 130 by electrostatic attraction between the piston structure 110 and the faceplate 130. As a result of the movement of the piston structure 110, a portion of the fluid 140 between the piston structure 110 and the faceplate 130 is forced out of the nozzle hole 132, forming a jet or drop of the fluid.

As the piston structure 110 approaches the faceplate 130, viscous forces opposing the flow F of the fluid 140 along a working surface 112 of the piston structure 110 and an inner surface 134 of the faceplate 130 result in a squeeze-film force $F_{sq}$ that resists the movement of the piston structure 110. The squeeze-film force $F_{sq}$ increases very rapidly as the piston structure 110 approaches the faceplate 130. Thus, the squeeze-film force $F_{sq}$ opposing the movement of the piston structure 110 becomes rather sizeable as a distance x between the piston structure 110 and the faceplate 130 gets small, such as, for example, less than 1 micron.

The dominant forces are the electrostatic force that drives the piston structure 110 towards the faceplate 130 and the squeeze-film force $F_{sq}$. As the piston structure 110 approaches closer and closer to the faceplate 130, the squeeze-film force $F_{sq}$ increases faster than the electrostatic attractive force between the piston structure 110 and the faceplate 130. The squeeze-film force $F_{sq}$ varies inversely with the cube of the distance x ($1/x^3$) while the electrostatic force varies inversely with the square of the distance x ($1/x^2$). As the distance x becomes very small, such as, on the order of 1 micron, the squeeze-film force $F_{sq}$ becomes equal to or greater than the electrostatic force. Thus, the squeeze-film force $F_{sq}$ stops the movement of the piston structure 110 towards the faceplate 130 before the piston structure 110 contacts the faceplate 130. With a proper voltage waveform, the electrostatic force is large enough to eject a desired drop of the fluid before the squeeze-film force $F_{sq}$ stops the movement of the piston structure 110.

Analysis of the situation shows that the squeeze-film force is of the order of:

$$F_{sq} = \left[\frac{2\pi\eta D^4}{32x^3}\right]u \tag{1}$$

where η is the viscosity of the fluid 140, D is a diameter of the piston structure 110, x is a distance between the piston structure 110 and the faceplate 130, and u is the velocity of the piston structure 110.

The squeeze-film force $F_{sq}$ increases rapidly and strongly when the distance between the piston structure 110 and the faceplate 130, x, becomes small. In various exemplary embodiments of the ejector 100, the piston structure 110, which at rest is about 5 $\mu$m from the faceplate 130, cannot approach closer than 1 to 2 $\mu$m to the faceplate 130 based on the available electric field and available movement time.

For example, in a typical ink-jet printing application where the ink viscosity is 2.5 centipoise, the diameter D of the piston structure is 70 $\mu$m and the distance x between the piston structure and the faceplate is 3 $\mu$m, the order of magnitude of the squeeze-film force $F_{sq}$ is approximately:

$$F_{sq} = \left(\frac{3(0.0025)\pi(70\times10^{-6})^4}{32(3\times10^{-6})^3}\right)1 = 0.00065477\ N \tag{2}$$

The piston structure 110 is assumed to move towards the faceplate 130 at a velocity that is on the order of 1 $\mu$m/$\mu$s, which is typical for a high-speed printing application.

In the exemplary electrostatic fluid ejector 100, the electrostatic force pulling the piston structure 110 towards the faceplate 130 is approximately:

$$F_e = \tfrac{1}{2}\kappa\epsilon_0 E^2 A \tag{3}$$

where:

k is the dielectric constant ($\kappa=\epsilon/\epsilon_0$);

E is the electric field in the ink between the piston structure 110 and the faceplate 130; and A is the area of the piston structure 110 influenced by the electric field E.

In practice, the electric field E is limited to a maximum value and is often kept at the maximum value to optimize output, as described in copending U.S. patent application Ser. No. 09/718,480, which is filed herewith and incorporated herein by reference in its entirety.

The area A of the piston structure 110 influenced by the electric field is largest when the area of the nozzle hole 132 is very small. For a circular piston structure 110, the area A is approximately:

$$A = \frac{\pi D^2}{4} \tag{4}$$

The electrostatic force $F_e$ is then approximately:

$$F_e = \frac{1}{2}\kappa\varepsilon_0 E^2\frac{\pi D^2}{4} = \frac{1}{8}\pi\kappa\varepsilon_0 D^2 E^2 \tag{5}$$

Using the values from above, with water as the dielectric, where water has a dielectric constant of 78, the electrostatic force $F_e$ which drives the piston structure 110 to eject the fluid, assuming a driving electric field E strength of 20V/$\mu$m, is approximately:

$$F_e = \tfrac{1}{8}\pi(78)(8.854\times10^{-12})(70\times10^{-6})^2(20\times10^{-6})^2 = 0.00053N \tag{6}$$

A squeeze-film force $F_{sq}$ of this magnitude, 0.655 mN, effectively forms a barrier against further advancement of the piston structure 110, since the squeeze-film force $F_{sq}$ of 0.655 mN cannot be overcome by the electrostatic force $F_e$ of 0.532 mN applied to the piston structure 110.

On the other hand, using an electric field E strength of 30 V/$\mu$m will develop an electrostatic force $F_e$ that is approximately:

$$F_e = \tfrac{1}{8}\pi(78)(8.854\times10^{-12})(70\times10^{-6})^2(30\times10^{-6})^2 = 0.0012N \tag{7}$$

This electrostatic force $F_e$ of 1.2 mN is sufficient to overcome the squeeze-film force $F_{sq}$ of 0.655 mN and move the piston structure 110 to eject a desired drop of the fluid 140.

As the calculations (6) and (7) indicate, the ability of the exemplary electrostatic fluid ejector 100 to rapidly advance the piston structure 110 and eject drops of the fluid 140 is dependent on the strength of the electric field E that is applied. Therefore, the exemplary electrostatic fluid ejector 100 is a high-field strength device that is dependent on the properties of the fluid 140, specifically the dielectric strength and the breakdown field strength of the fluid 140.

It should be noted that an additional effect may be obtained when the faceplate 130 is very thin, such as, for example, on the order of 1–2 microns. This additional effect, called the "oil can effect", occurs when the faceplate 130 flexes toward the piston structure 110 because of the attractive electrostatic force between the piston structure 110 and the faceplate 130. The flexing of the faceplate 130 imparts an additional pressure to the fluid 140 and enhances drop ejection.

FIG. 2 shows a second exemplary embodiment of an electrostatic microelectromechanical system (MEMS) based fluid ejector 200 according to the present invention. The ejector 200 comprises a movable piston structure 210 and a stationary faceplate 230. A cylinder structure 250 extends from the faceplate 230 and defines a fluid chamber 220 between the piston structure 210 and the faceplate 230. A fluid 240 to be ejected is supplied to the fluid chamber 220. The piston structure 210 is arranged to move within the cylinder structure 250 past an inner wall 252 with a gap g so that a fluid jet or drop is ejected through a nozzle hole 232 in the faceplate 230. According to this exemplary embodiment, a free space 260 is provided between the piston structure 210 and the faceplate 230.

In the exemplary embodiment shown in FIG. 2, the piston structure 210 may be displaced a predetermined distance from its rest position near an end of the cylinder structure 250 to achieve a maximum stroke height s of the piston structure 210. A height h of an inner wall 252 of the cylinder structure 250 is thus equal to the maximum stroke height s of the piston structure 210. The piston structure 210 may be moved by electrostatic attraction between the piston structure 210 and the faceplate 230. Alternatively or additionally, the piston structure 210 may be moved by electrostatic fringe field effects between the piston structure 210 and the side walls of the cylinder structure 250. As a result of the movement of the piston structure 210, a portion of the fluid 240 in the fluid chamber 220 is forced out of the nozzle hole 232, forming a jet or drop of the fluid.

The maximum stroke height s prevents the piston structure 210 from entering the free space 260. Therefore, as the piston structure 210 moves towards the faceplate 230 so that a distance x between the piston structure 210 and the faceplate 230 decreases, the resulting squeeze-film force $F_{sq}$ is very small and offers relatively little opposition to the movement of the piston structure 210. As illustrated by Eq. (1) above, since the distance x remains relatively large even at the maximum stroke height s of the piston structure 210, the squeeze-film force $F_{sq}$ is relatively small.

For a square piston structure 210 on the order of 30 to 80 $\mu$m side dimension and having a stroke of about 3 to 5 $\mu$m, the amount of the fluid 240 ejected from the nozzle hole 232 will be on the order of a few picoliters for an approximately 20 $\mu$m diameter nozzle hole 232.

In FIG. 3, using Eq. (1) and the values form above, the squeeze-film force $F_{sq}$ is plotted as the piston structure 110 or 210 is moved towards the faceplate 130 or 230 for the exemplary embodiments described above and shown in FIGS. 1 and 2. Curve A represents the embodiment of FIG. 1 without a cylinder structure or free space. Curve B represents the embodiment of FIG. 2 with a cylinder structure that extends 3 $\mu$m above the maximum stroke height s of the piston structure 210.

As illustrated by the graph shown in FIG. 3, the exemplary embodiment shown in FIG. 1 shows a very sharp increase in the squeeze-film force $F_{sq}$ which prevents the piston structure 110 from contacting the faceplate 130. In contrast, for the embodiment shown in FIG. 2, the graph shown in FIG. 3 shows that the squeeze-film force $F_{sq}$ remains relatively low and constant as the piston structure 210 moves from zero to 4 $\mu$m, within 1 $\mu$m of the maximum stroke height s.

According to this exemplary embodiment, the viscous forces opposing movement of the piston structure 210 result from a shear fluid flow f between an edge of the piston structure 210 and the inner wall 252 of the cylinder structure 250.

As illustrated in FIG. 4, the piston structure 210 is arranged to move within the cylinder structure 250 past an inner wall 252 with a gap g and towards the faceplate 230 with the nozzle hole 232. The fluid 240 is supplied in the fluid chamber 220 from a reservoir (not shown). A shear force $F_s$ of the shear fluid flow f can be estimated as:

$$F_s = \left[\frac{\pi\eta D(h-x)}{g}\right]u \tag{8}$$

where:

- $\eta$ is the viscosity of the fluid 240;
- D is the diameter of the piston structure 210;
- x is a distance between the piston structure 210 its maximum stroke height s;
- g is the gap between the inner wall 252 of the cylinder structure 250 and the edge of the piston structure 210; and
- u is the velocity of the piston structure 210.

The shear force $F_s$ does not increase as the piston structure 210 moves towards the faceplate 230.

An additional force resisting the movement of the piston structure 210 becomes significant in this exemplary embodiment. A convergence force $F_c$ is generated by a pressure increase in the fluid 240 in the fluid chamber 220, between the piston structure 210 and the faceplate 230, as a volume of the fluid 240 is forced from a relatively large cross-sectional area of the fluid chamber 220 through a relatively small cross-sectional area of the nozzle hole 232. The pressure increase $\Delta p$ in the volume of the in the fluid 240 in the fluid chamber 220 may be estimated as:

$$\Delta p = 3\dot{q}\eta/a^3 \tag{9}$$

where:

- $\eta$ is the viscosity of the fluid 240;
- $\dot{q}$ is the volume rate of flow of the fluid 240 through the nozzle hole 232; and
- a is the radius of the nozzle hole 232.

If the piston structure 210 is a square with a side of length w, the pressure increase $\Delta p$ may be converted into the convergence force $F_c$ by:

$$F_c = 3\eta w^4\dot{x}/a^3 \tag{10}$$

where $\dot{x}$ is the velocity of the piston structure 210.

The electrostatic forces driving the movement of the piston structure are also different for the two exemplary embodiments shown in FIGS. 1 and 2 because parallel plate electrostatic actuation is implemented in the configuration of FIG. 1, while fringe field electrostatic actuation is implemented in the configuration of FIG. 2. For the exemplary embodiment shown in FIG. 1, the electrostatic force $F_{ep}$ is approximately:

$$F_{ep} = \left[\frac{1}{8}\pi D^2\right]\varepsilon E^2 \tag{11}$$

where:

- $\epsilon$ is the permittivity of the fluid 140
- D is the diameter of the piston structure 110; and
- E is the magnitude of the electric field generated between the piston structure 110 and the faceplate 130.

For the exemplary embodiment shown in FIG. 2, the electrostatic force $F_{ec}$ is approximately:

$$F_{ec} = \left[\frac{1}{2}\pi Dg\right]\varepsilon E^2 \tag{12}$$

where

- $\epsilon$ is the permittivity of the fluid 240;
- D is the diameter of the piston structure 210, g is the gap between the inner wall 252 of the cylinder structure 250 and the edge of the piston structure 210; and
- E is the magnitude of the electric field generated between the piston structure 210 and the side walls of the cylinder structure 250.

In the exemplary embodiment shown in FIG. 2, the squeeze-film force $F_{sq}$ may be ignored, assuming that the piston structure 210 is kept far enough away from the faceplate 230. Therefore, the fringing-field electrostatic force $F_{ec}$ must be greater than the sum of the convergence force $F_c$ and the shear force $F_s$ to drive the piston structure 210 and eject a desired drop of the fluid 240.

For typical values of w=70 $\mu$m, $\dot{x}$=1 m/s, a=10 $\mu$m, and $\eta=3\times10^{-3}$Ns/m$^2$ (a viscosity three times that of water), the convergence force $F_c$ is approximately $2.16\times10^{-4}$N, using equation (10). The squeeze-film force $F_{sq}$ is approximately $3.3\times10^{-6}$N, where the gap g is 1 $\mu$m and the free space 260 yields an (h−x) value of 5 $\mu$m. The fringing-field electrostatic force $F_{ec}$ is approximately $6.831\times10^{-5}$N for an electric field magnitude E of 30V/$\mu$m. Since the driving electrostatic force of $6.831\times10^{-5}$N is smaller than the sum of the resisting forces of $2.19\times10^{-4}$, the piston structure 210 cannot be advanced to eject a drop of the fluid 240 in this configuration.

The dominant force is the convergence force $F_c$. Thus, a design modification that reduces or eliminates the convergence force $F_c$ while not significantly affecting the other forces will allow the piston structure 210 to be advanced to eject a drop of the fluid 240. One approach is to make the piston structure 210 approximately the same size as the nozzle hole 232. In such a case, the convergence force $F_c$ is approximately zero. Thus, for the square piston structure 210 with w=70 $\mu$m and the nozzle hole 232 with an equivalent area, the shear force $F_s$ and the fringing-field electrostatic force $F_{ec}$ remain $3.3\times10^{-6}$N and $6.831\times10^{-5}$N, respectively. The net force acting on the piston structure 210 is approximately $6.5\times10^{-5}$N, which is sufficient to move the piston structure 210 and eject a drop.

For the exemplary embodiment shown in FIG. 2, there is some limitation set by the manufacturing technique. Several specific modifications may be considered and selected in light of the limitations of the specific fabrication method.

For example, in the SUMMiT processes, the free space may be provided by modifying the upper layer or by including an additional layer. Alternately, the free space may be provided by removing material from the inner side of the faceplate 230. Specific methods for forming features on a substrate-facing surface of a layer are discussed in the incorporated Ser. No. 09/723,243 application, as noted above.

The exemplary embodiment shown in FIG. 2 can be manufactured in a side-shooter configuration using the SUMMiT processes. FIGS. 5 and 6 show this alternative configuration for the exemplary embodiment shown in FIG. 2. As shown in FIGS. 5 and 6, the cylinder structure 350 of the side-shooter ejector 300 includes endwalls 354. Also, an ink feed 375 is formed through a substrate 370 on which the cylinder structure 350 is formed.

In this configuration, an electrostatic field is generated between the movable piston structure 310 and at least one of the endwalls 354 of the ejector 300. Thus, the piston structure 310 is driven substantially perpendicular to the nozzle hole 332 by electrostatic attraction between the piston structure 310 and the at least one of the endwalls 354. The piston structure 310 moves within the cylinder structure 350, between the sidewalls 352, to force a portion of the fluid 340 between the piston structure 310, the at least one of the endwalls 354 and the faceplate 330 out of the nozzle hole 332 to form a jet or drop of the fluid. It should be appreciated that a significantly longer stroke of the piston structure 310 is possible in this configuration compared to the configuration shown in FIG. 2.

However, similar stroke lengths, on the order of 5 $\mu$m, will produce similar size drops as with the configuration of FIG. 2. The free-space advantages of the configuration of FIG. 2 may be implemented in the configuration of FIG. 5 by keeping the maximum stroke length position of the piston structure 310 a given distance, for example, 3 $\mu$m, from the at least one of the endwalls 354.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A microelectromechanical system based fluid ejector, comprising:

a faceplate having at least one ejector nozzle;

a substrate on which the faceplate is mounted;

a cylinder structure between the faceplate and the substrate, the cylinder structure having a first endwall and a second endwall that at least partially define a chamber that communicates with the at least one ejector nozzle, the second end wall located a predetermined distance from the least one ejector nozzle; and a movable piston arranged to move in the chamber away from the first endwall towards the second endwall with a predetermined maximum stroke, the predetermined maximum stroke being less than the predetermined distance such that viscous resistance against movement of the piston towards the second wall by a fluid in the chamber is primarily a result of sheer flow of the fluid between the piston and an inner circumference of the cylinder structure.

2. A microelectromechanical system based fluid ejector, comprising:

a faceplate having at least one ejector nozzle;

a substrate on which the faceplate is mounted;

a cylinder structure extending between the faceplate and the substrate, the cylinder structure having endwalls and sidewalls that at least partially define a chamber that communicates with the at least one ejector nozzle, the second end wall located a predetermined distance from the least one ejector nozzle; and a movable piston arranged to move in the chamber with a predetermined maximum stroke, the predetermined maximum stroke being less than the predetermined distance such that viscous resistance against movement of the piston towards the second endwall by a fluid in the chamber varies substantially linearly with a stroke distance of the piston.

3. A microelectromechanical system based fluid ejector, comprising:

a faceplate having at least one ejector nozzle;

a cylinder structure extending from the faceplate a predetermined distance and having an inner circumference, the inner circumference defining a chamber that communicates with the at least one ejector nozzle; and a movable piston arranged to move in the chamber with a predetermined maximum stroke, the predetermined maximum stroke being less than the predetermined distance such that viscous resistance against movement of the piston towards the faceplate by a fluid in the chamber is primarily a result of shear flow of the fluid between the piston and the inner circumference of the cylinder structure.

4. A microelectromechanical system based fluid ejector, comprising:

a faceplate having at least one ejector nozzle;

a cylinder structure extending from the faceplate a predetermined distance and having an inner circumference, the inner circumference defining a chamber that communicates with the at least one ejector nozzle; and a movable piston arranged to move in the chamber with a predetermined maximum stroke, the predetermined maximum stroke being less than the predetermined distance such that viscous resistance against movement of the piston towards the faceplate by a fluid in the chamber varies substantially linearly with a stroke distance of the piston.

5. A microelectromechanical system based liquid ejector, comprising:

a faceplate having at least one ejector nozzle; and a movable piston arranged to move within a fluid chamber towards the faceplate such that a drop of fluid is ejected from the fluid chamber through the at least one ejector nozzle;

wherein viscous resistance against movement of the piston towards the faceplate by the fluid in the fluid chamber prevents the piston from contacting the faceplate.

6. A method for ejecting a fluid using a microelectromechanical system based fluid ejector having a chamber within a cylinder structure between a faceplate and a substrate of the ejector, the cylinder structure having a first endwall and a second endwall, the second end wall located a predetermined distance from an ejector nozzle of the faceplate, the method comprising:

moving a movable piston within the cylinder structure away from the first endwall and towards the second endwall with a predetermined maximum stroke, the predetermined maximum stroke being less than the predetermined distance such that viscous resistance against movement of the piston towards the second wall by a fluid in the chamber is primarily a result of shear flow of the fluid between the piston and an inner circumference of the cylinder structure.

7. A method for ejecting a fluid using a microelectromechanical system based fluid ejector having a chamber within a cylinder structure between a faceplate and a substrate of the ejector, the cylinder structure having a first endwall and a second endwall, the second end wall located a predetermined distance from an ejector nozzle of the faceplate, the method comprising:

moving a movable piston within the cylinder structure away from the first endwall and towards the second endwall with a predetermined maximum stroke, the predetermined maximum stroke being less than the predetermined distance such that viscous resistance against movement of the piston towards the second endwall by a fluid in the chamber varies substantially linearly with a stroke distance of the piston.

8. A method for ejecting a fluid using a microelectromechanical system based fluid ejector having a chamber within a cylinder structure extending from a faceplate a predetermined distance, comprising:

moving a movable piston within the cylinder structure towards the faceplate with a predetermined maximum stroke, the predetermined maximum stroke being less than the predetermined distance such that viscous resistance against movement of the piston towards the faceplate by a fluid in the chamber is primarily a result of sheer flow of the fluid between the piston and the inner circumference of the cylinder structure.

9. A method for ejecting a fluid using a microelectromechanical system based fluid ejector having a chamber within a cylinder structure extending from a faceplate a predetermined distance, the method comprising:

moving a movable piston within the cylinder structure towards the faceplate with a predetermined maximum stroke, the predetermined maximum stroke being less than the predetermined distance such that viscous resistance against movement of the piston towards the faceplate by a fluid in the chamber varies substantially linearly with a stroke distance of the piston.

10. A method for ejecting fluid using a microelectromechanical system based fluid ejector, comprising:

moving a movable piston within a fluid chamber towards a faceplate having at least one ejector nozzle such that a drop of fluid is ejected from the fluid chamber through the at least one ejector nozzle; and preventing the piston from contacting the faceplate based on viscous resistance against movement of the piston towards the faceplate by the fluid in the fluid chamber.

* * * * *

UNITED STATES PATENT AND TRADEMARK OFFICE

CERTIFICATE OF CORRECTION

PATENT NO. : 6,416,169 B1
DATED : July 9, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*